US007548710B2

(12) United States Patent
Gayne et al.

(10) Patent No.: US 7,548,710 B2
(45) Date of Patent: Jun. 16, 2009

(54) DUAL SLIDING SHUTTER SYSTEM

(75) Inventors: Jarrett C. Gayne, Lexington, KY (US); Jedediah Taylor Dawson, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 18 days.

(21) Appl. No.: 11/552,671

(22) Filed: Oct. 25, 2006

(65) Prior Publication Data

US 2008/0101821 A1 May 1, 2008

(51) Int. Cl.
*G03G 15/08* (2006.01)

(52) U.S. Cl. ..... 399/120; 399/258; 399/262

(58) Field of Classification Search ..... 399/262, 399/258, 119, 120, 106; 347/49, 86
See application file for complete search history.

(56) References Cited

U.S. PATENT DOCUMENTS 5,842,093 A * 11/1998 Tanda ..... 399/120 X
2002/0085857 A1* 7/2002 Kim et al. ..... 399/119
2005/0135842 A1* 6/2005 Murakami et al. ..... 399/262
2005/0226658 A1* 10/2005 Haruyama ..... 399/258
2006/0280526 A1* 12/2006 Shimomura ..... 399/258

FOREIGN PATENT DOCUMENTS

JP 2001-083792 A * 3/2001

OTHER PUBLICATIONS

Machine translation of JP 2001-083792 A dated Mar. 5, 2008.*

* cited by examiner

*Primary Examiner*—Sophia S Chen
(74) *Attorney, Agent, or Firm*—Coats & Bennett P.L.L.C.

(57) ABSTRACT

An image forming device includes a removable cartridge holding toner, supplying toner to a developer. The cartridge and developer each include a shutter to retain toner when the cartridge is removed. Upon insertion, the developer abuts the cartridge shutter, and the cartridge abuts the developer shutter, such that movement of the shutter into the image forming device opens both the shutters. Additionally upon insertion, the cartridge shutter releasably engages with the developer, and the cartridge releasably engages with the developer shutter. Upon removing the cartridge, the developer pulls the cartridge shutter closed prior to releasing engagement, and the cartridge pulls the developer shutter closed prior to releasing engagement. The opening and closing of both shutters requires only a single movement by the user: inserting or removing the cartridge from the image forming device.

22 Claims, 7 Drawing Sheets

DUAL SLIDING SHUTTER SYSTEM

BACKGROUND

The present invention relates generally to image forming devices, and in particular to a dual sliding shutter system for adding toner to an image forming machine.

Toner is a dry, powdered form of ink applied to media sheets in electrophotographic image forming devices. Toner is a consumable item, which must be replenished periodically. Pouring toner from a bottle into a toner reservoir in the image forming device is a notoriously messy operation, often staining a user's hands and clothes with toner, resulting in user dissatisfaction.

Cartridges that contain toner and are inserted as a unit into the image forming device to replenish its toner supply are known in the art. Typically, a toner cartridge is inserted using one motion, e.g., sliding the cartridge into place, and an integral door or shutter is opened using a different motion, e.g., twisting the cartridge about its axis, to open a passageway for toner to flow from the cartridge into a developer unit in the image forming device. These cartridges are difficult for inexperienced users to properly install, resulting in cartridges that are improperly inserted, inserted but not twisted properly such that the toner does not flow from the cartridge or only partially flows, and the like.

In another type of toner cartridge known in the art, shutters on the toner cartridge and/or the developer are held in a closed position by springs. When the toner cartridge is inserted into an image forming device, the shutters are opened, allowing toner to flow. Upon removal of the cartridge, the springs move the shutters to the closed positions. In these cartridges, the spring forces must be overcome upon inserting the cartridge. That is, the spring forces oppose the insertion of the cartridge into the image forming device, increasing the required insertion force. Additionally, the springs add cost and complexity to cartridge design.

SUMMARY

In one embodiment, the invention relates to an image forming device. The image forming device includes a developer supplying toner to an image forming station, and a removable cartridge holding a supply of toner, in toner flow relationship with the developer when the cartridge is inserted into the image forming device. The developer includes a shutter operative to retain toner in the developer in a closed position, and operative to allow toner to flow into the developer in an open position. Both the developer shutter and the cartridge shutter are moved to the open position by inserting the cartridge into the image forming device, and both the developer shutter and the cartridge shutter are moved to the closed position by removing the cartridge from the image forming device.

In another embodiment, the invention relates to an image forming device The image forming device includes a protrusion connected to a static element in the image forming device, and a developer supplying toner to an image forming station. The image forming device also includes a removable cartridge holding a supply of toner, in toner flow relationship with the developer when the cartridge is inserted into the image forming device. The cartridge includes a shutter operative to retain toner within the cartridge in a closed position, and operative to allow toner to flow from the cartridge in an open position. The channel also has a channel having two side walls, within which the cartridge shutter moves between the closed and open positions, with a recess formed in at least one of the side walls. At least one deformable protrusion member is connected to the cartridge shutter, each disposed adjacent a side wall of the channel and, with the cartridge shutter in the closed position, operative to engage a corresponding static element protrusion by deforming outwardly from the cartridge shutter into a corresponding channel side wall recess as the cartridge is inserted into the image forming device. As the cartridge is inserted further into the image forming device, contact with the static member moves the cartridge shutter from the closed to the open position within the channel, and the deformable protrusion members are locked into engagement with the corresponding static element protrusions by the channel side walls.

DETAILED DESCRIPTION

An image forming device suitable for use with the present invention may include a laser printer (mono or color), facsimile, copier, or combination of two or more of these devices, which is often referred to as an all-in-one device. The device may be sized to fit on a workspace, such as a desktop. The device may further include accessible work areas for the user to insert and remove media sheets, replace components within the device, and clear media jams from within the device.

Figure 1:
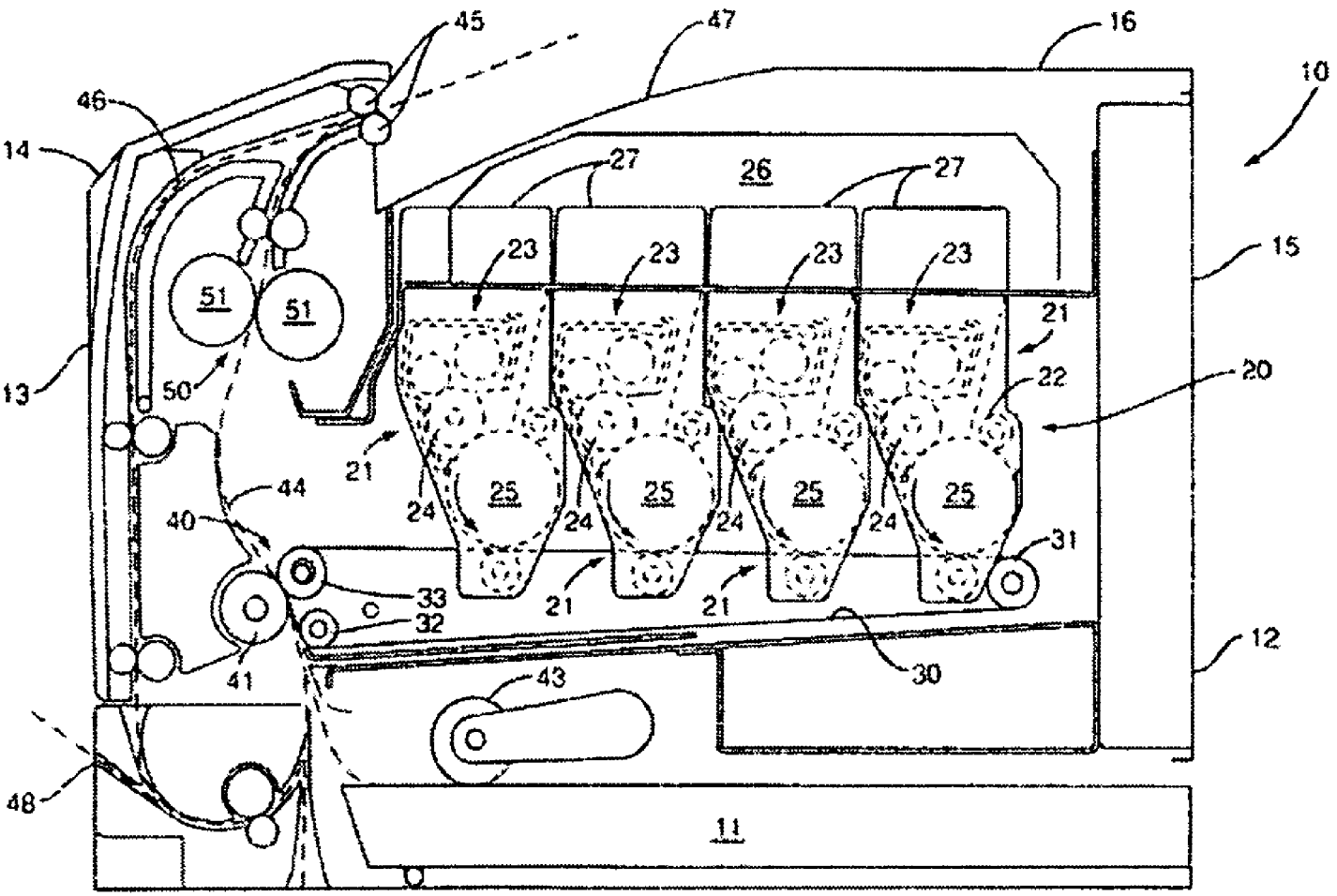
FIG. 1 is a section view of a representative image forming device.

FIG. 1 illustrates one embodiment of an image forming device, generally illustrated as 10. The device 10 includes a media input tray 11 positioned in a lower section of a body 12. The tray 11 is sized to contain a stack of media sheets that will receive color and/or monochrome images. The media input tray 11 is preferably removable for refilling. Therefore, in this embodiment, a user may insert and remove the media input tray 11 from the device 10 through a front 13 of the body 12. A control panel 14 may be located on the front 13 of the body 12. Using the control panel 14, the user is able to enter commands and generally control the operation of the image-forming device 10. For example, the user may enter commands to switch modes (e.g., color mode, monochrome mode), view the number of images printed, take the device 10 on/off line to perform periodic maintenance, and the like.

A first toner transfer area 20 includes one or more imaging units 21 that are aligned horizontally extending from the front 13 to a back 15 of the body 12. Each imaging unit 21 includes a charging roll 22, a developer 23 that includes various paddles and rollers for stirring and moving toner and a developer roll 24, and a rotating photoconductive (PC) drum 25. The charging roll 22 forms a nip with the PC drum 25, and charges the surface of the PC drum 25 to a specified voltage such as −1000 volts, for example. A laser beam from a printhead 26 contacts the surface of the PC drum 25 and discharges those areas it contacts to form a latent image. In one embodiment, areas on the PC drum 25 illuminated by the laser beam are discharged to approximately −300 volts. The developer roll 24, which also forms a nip with the PC drum 25, then transfers toner particles from a cartridge 27 containing a supply of toner to the PC drum 25, to form a toner image. The toner particles are attracted to the areas of the PC drum 25 surface discharged by the laser beam from the printhead 26.

A removable toner cartridge 27 is operatively connected to each of the developers 23 in toner transfer relationship, when the toner cartridge 27 is inserted into the imaging forming device 10. The toner cartridges 27 are sized to contain toner that is transferred to the developers 23 for image formation. The toner cartridges 27 may be mounted and removed from the device 10 independently from the imaging units 21. In one embodiment, the toner cartridges 27 each contain one of black, magenta, cyan, or yellow toner. Each of toner cartridges 27 may be substantially the same, or one or more of the toner cartridges 27 may hold different toner capacities. In one specific embodiment, the black toner cartridge 27 has a higher capacity than the others. The toner cartridges 27 may mount from a top 16 of the device 10, in a generally vertical direction, and may detach during removal with the imaging units 21 remaining within the device 10.

An intermediate transfer mechanism (ITM) 30 is disposed adjacent to each of the imaging units 21. In this embodiment, the ITM 30 is formed as an endless belt trained about support roller 31, tension roller 32 and back-up roller 33. The belt may be constructed from a variety of materials including polyimide, Ethylene TetrafluoroEthylene (ETFE), nylon, thermoplastic elastomers (TPE), polyamide-imid, and polycarbonate alloy. During image forming operations, the ITM 30 moves past the imaging units 21 in a clockwise direction as viewed in FIG. 1. One or more of the PC drums 25 apply toner images in their respective colors to the ITM 30. In one embodiment, a positive voltage field attracts the toner image from the PC drums 25 to the surface of the moving ITM 30.

The ITM 30 rotates and collects the one or more toner images from the imaging units 21 and then conveys the toner images to a media sheet at a second transfer area. The second transfer area includes a second transfer nip 40 formed between the back-up roller 33 and a second transfer roller 41.

A media path 44 extends through the device 10 for moving the media sheets through the imaging process. Media sheets are initially stored in the input tray 11 or introduced into the body 12 through a manual feed 48. The sheets in the input tray 11 are picked by a pick mechanism 43 and moved into the media path 44. In this embodiment, the pick mechanism 43 includes a roller positioned at the end of a pivoting arm. The roller rotates to move the media sheets from input tray 11 towards the second transfer area. In one embodiment, the pick mechanism 43 is positioned in proximity (i.e., less than a length of a media sheet) to the second transfer area with the pick mechanism 43 moving the media sheets directly from the input tray 11 into the second transfer nip 40. For sheets entering through the manual feed 48, one or more rollers are positioned to move the sheet into the second transfer nip 40.

The media sheet receives the toner image from the ITM 30 as it moves through the second transfer nip 40. The media sheets with toner images are then moved along the media path 44 and into a fuser area 50. Fuser area 50 includes fusing rollers or belts 51 that form a nip to adhere the toner image to the media sheet. The fused media sheets then pass through exit rollers 45 that are located downstream from the fuser area 50. Exit rollers 45 may be rotated in either forward or reverse directions. In a forward direction, the exit rollers 45 move the media sheet from the media path 44 to an output area 47. In a reverse direction, the exit rollers 45 move the media sheet into a duplex path 46 for image formation on a second side of the media sheet.

As discussed above, replaceable toner cartridges 27 supply toner as needed to respective developers 23. The toner cartridge 27 is considered a consumable supply item to be replaced in several times over the life of the imaging unit 21. An interface between the cartridge 27 and the developer 23 must allow toner to pass from the cartridge 27 to the developer 23 when the cartridge 27 is seated in the image forming device 10. However, toner must not leak from the cartridge 27 or the developer 23 when the cartridge is not seated in an operative position in the image forming device 10. To prevent toner leakage, one or more "shutters" may be provided to selectively cover the passages through which toner is transferred from the cartridge 27 to the developer 23.

The shutters are movable between closed positions, where they retain toner within the cartridge 27 or developer 23, and open positions, where they allow toner to flow from the cartridge 27 into the developer 23 through passages in both units that are aligned when the cartridge 27 is seated in the image forming device 10. According to one or more embodiments disclosed herein, shutters on one or both of the cartridge 27 and the developer 23 are moved from a closed position to an open position as the cartridge 27 is inserted into the image forming device 10. Additionally, the shutters are positively moved from the open position to the closed position as the cartridge 27 is removed from the image forming device 10. Notably, no user action (other than instructing or removing the cartridge 27) is required to open or close either shutter.

Figure 2:
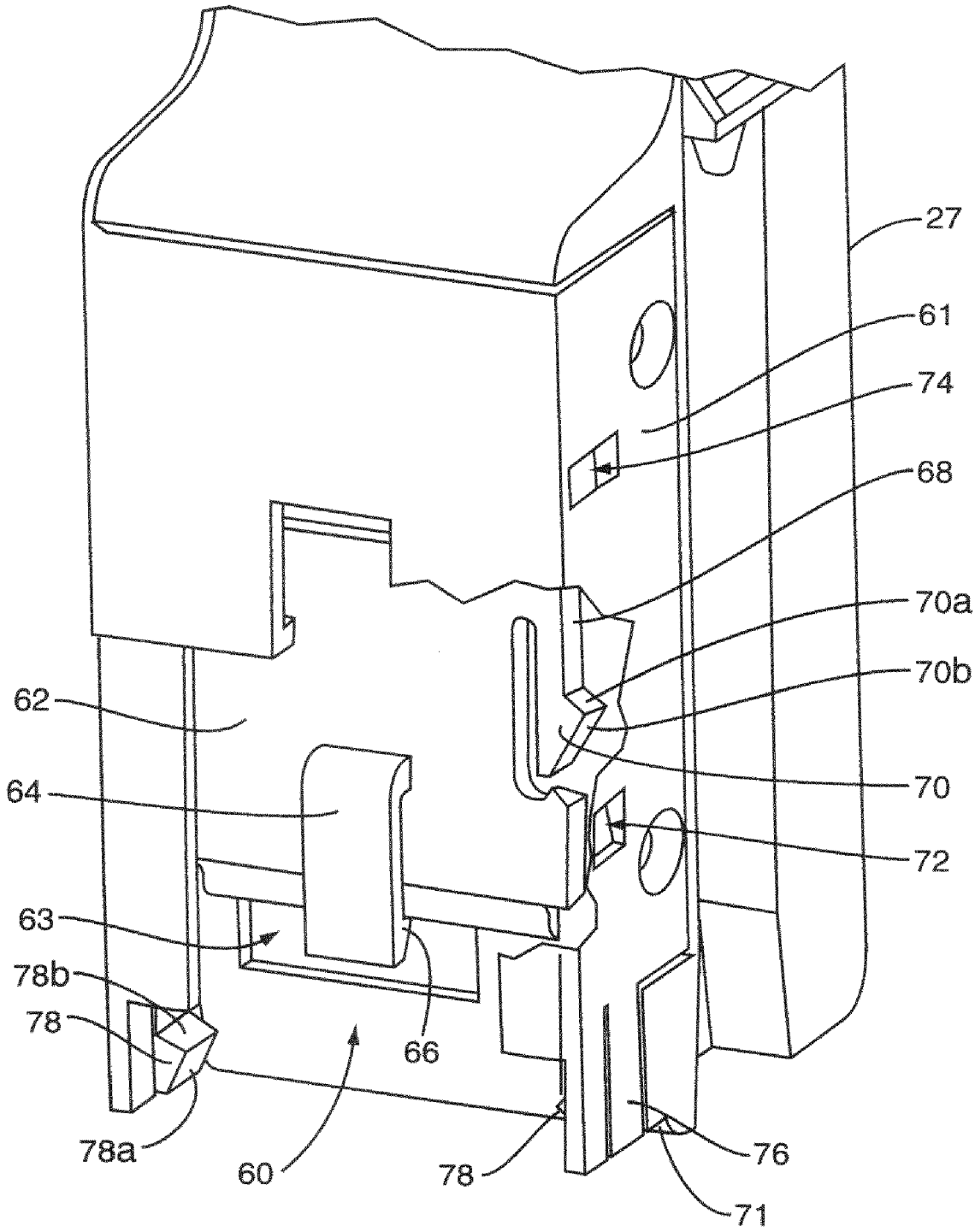
FIG. 2 is a perspective view of a portion of a toner cartridge.

FIG. 2 depicts a portion of a toner cartridge 27. A cartridge shutter 62 is disposed in a cartridge shutter channel 60 formed at least partially by side walls 61. The cartridge shutter 62 is depicted between its closed and open positions, partially covering a cartridge toner passage 63. The cartridge shutter 62 includes a deformable detent in the form of a pliable arm 68 on which a protrusion 70 is formed by surfaces 70*a*, 70*b*. The cartridge shutter detent 68 holds the cartridge shutter 62 in the closed position, covering the cartridge toner passage 63, when the protrusion 70 engages in recess 72 formed in a corresponding side wall 61. A force $F_{C\text{-}UNLOCK}$ is required to overcome the detent 68 and move the cartridge shutter 62 from the closed position. Similarly, the cartridge shutter detent 68 holds the cartridge shutter 62 in the open position, fully exposing the cartridge toner passage 63 and allowing toner to flow out of the cartridge 27, when the protrusion 70 engages in recess 74. A force $F_{C\text{-}LOCK}$ is required to overcome the detent 68 and move the cartridge shutter 62 from the open position. As will be further detailed herein, the force required to dislodge the detent 68 from the recesses 72, 74 differs (that is, $F_{C\text{-}LOCK} \neq F_{C\text{-}UNLOCK}$) based on the relative angles of surfaces 70*a* and 70*b*. As used herein, the term "detent" is to be broadly construed to include any element or mechanism that locks or arrests the movement of a shutter.

Figure 3:
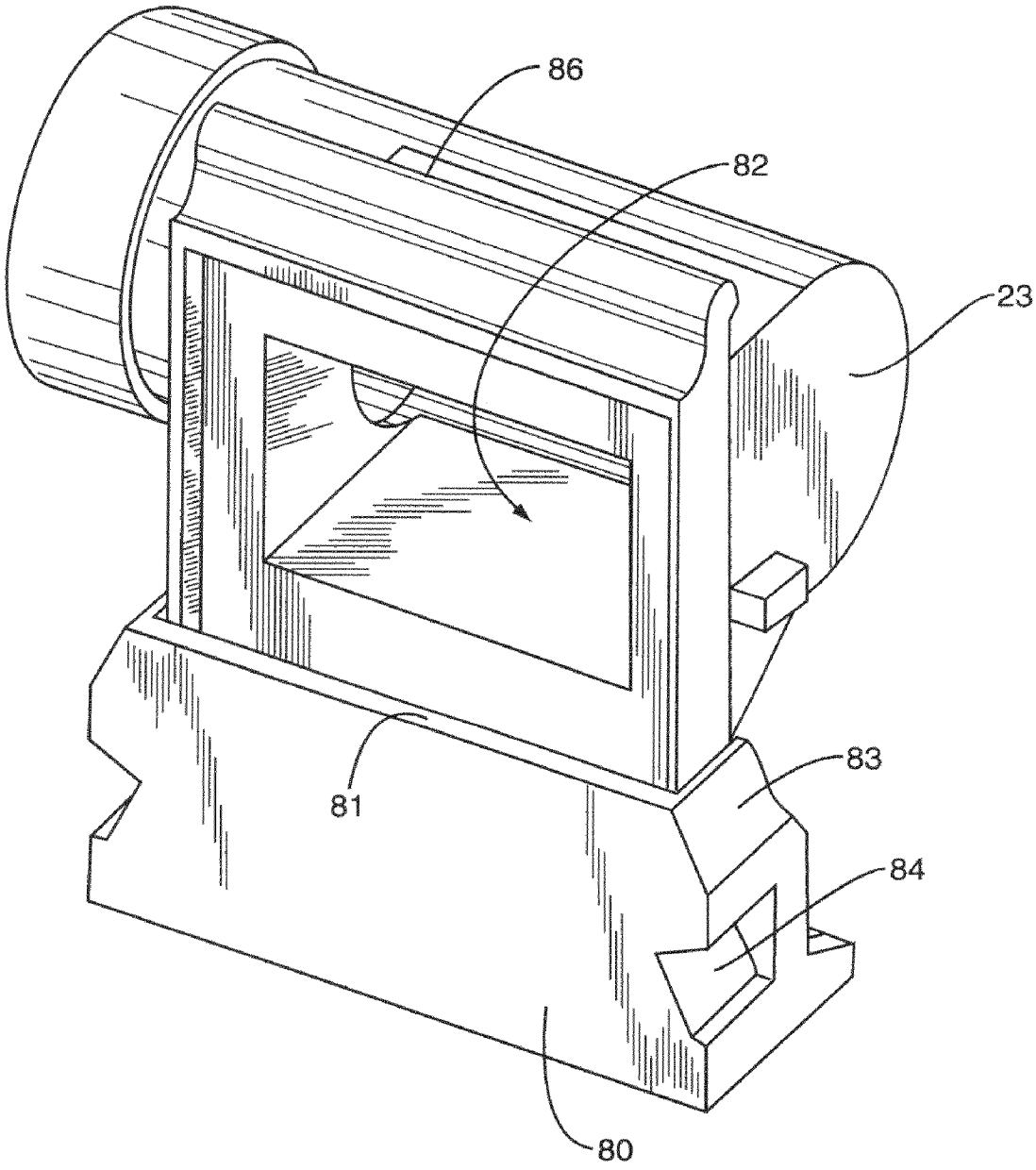
FIG. 3 is a perspective view of part of a developer in an image forming device.
Figure 4:
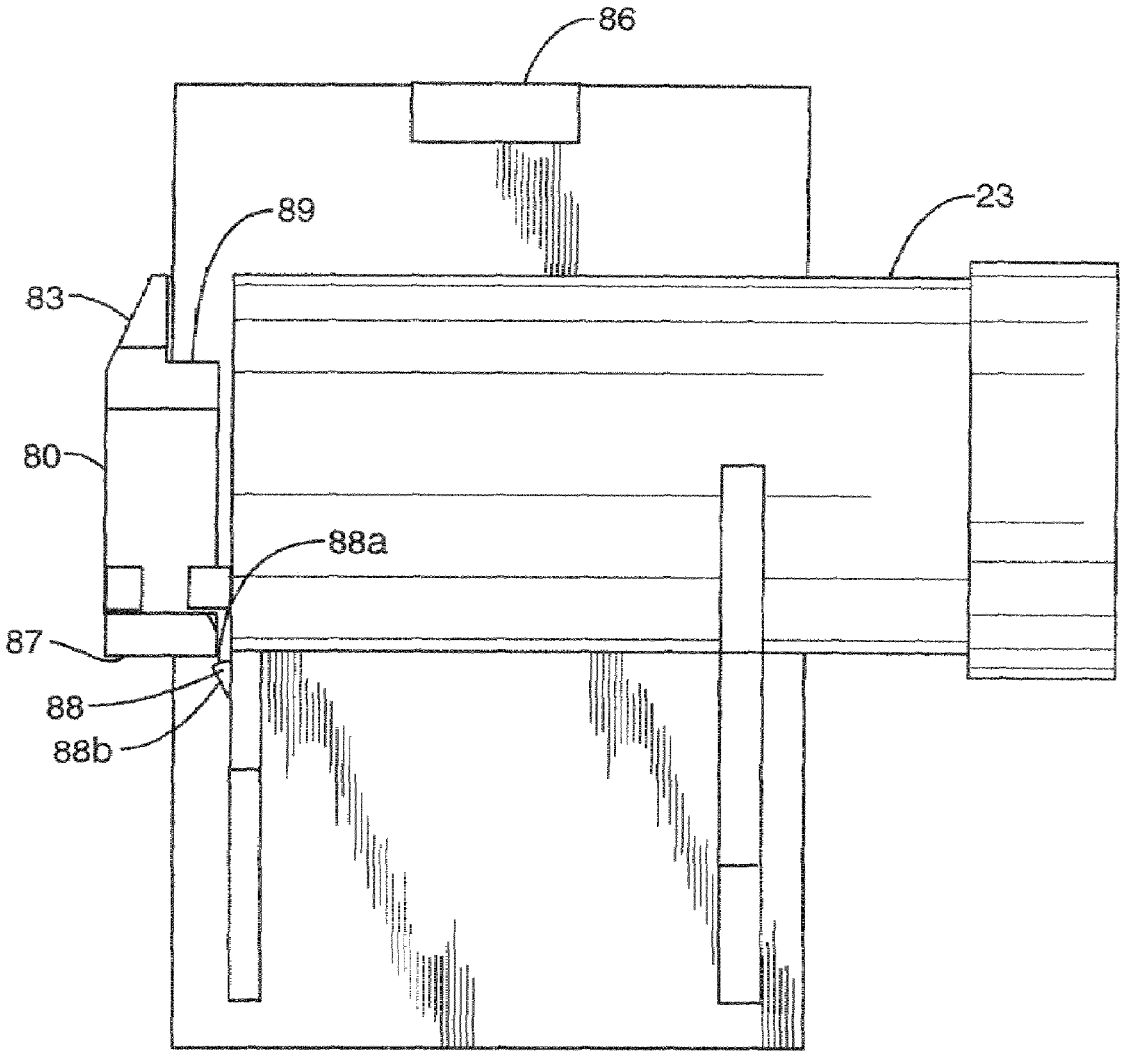
FIG. 4 is an alternate view of the developer part.

FIGS. 3 and 4 depict a part of the developer 23 that receives toner from a corresponding cartridge 27 and transports the toner to an operative area of the developer 23. The developer 23 includes a developer toner passage 82, through which toner flows from the toner cartridge 27. The developer toner passage 82 is selectively covered by a developer shutter 80, movable between an open position, as depicted in FIG. 3, and a closed position, as depicted in FIG. 4. A detent 88 (FIG. 4) holds the developer shutter 80 in a closed position by engagement with a lower edge 87 of the developer shutter 80, requiring the application of a force $F_{D\text{-}UNLOCK}$ to move the developer shutter 80 from the closed position. The detent 88 holds the developer shutter 80 in an open position by engagement with an upper edge 89, requiring the application of a force $F_{D\text{-}UNLOCK}$ to move the developer shutter 80 from the open position. Here again, $F_{D\text{-}LOCK} \neq F_{D\text{-}UNLOCK}$, the difference depending on the relative angles of the detent 88 surfaces 88*a* and 88*b*.

According to one or more embodiments, the cartridge shutter 62 and the developer shutter 80—both of which are maintained in the closed position when the toner cartridge 27 is out of the image forming device 10—are moved from closed to open positions by contact with the developer 23 and cartridge 27, respectively, as the toner cartridge 27 is inserted into the image forming device 10 In particular, a lower edge of the cartridge shutter 62 contacts an upper edge of a shutter engagement element 86 formed on the developer 23. As the toner cartridge 27 is inserted into the image forming device 10, and moves in a generally downward direction as depicted in FIGS. 2-6, the upper edge of the shutter engagement element 86 forces the cartridge shutter 62 from the closed to the open position.

In some embodiments, the cartridge shutter 62 may engage a static part in the image forming device 10—meaning a part that is rigidly fixed in the image forming device with respect to the removable cartridge 27—in lieu of the shutter engagement element 86 or other part of the developer 23. For the cartridge shutter 62 to move from the closed position covering the toner passage 63, the cartridge shutter detent 68 must be dislodged from the recess 72. As the toner cartridge 27 is fully seated in the image forming device, the cartridge shutter 62 is moved to the fully open position, where the detent 68 engages in the recess 74 to hold the cartridge shutter 62 in the open position.

Similarly, as the toner cartridge 27 is inserted into the image forming device 10, a lower edge or lip 71 of the cartridge 27 abuts an upper edge 81 of the developer shutter 80, and pushes the developer shutter 80 downwardly from the closed position to the open position. To dislodge the developer shutter 80 from the closed position, the developer detent 88 must be deformed. The detent 88 also holds the developer shutter 80 in the open position when the cartridge 27 is fully inserted in the image forming device 10.

Figure 5:
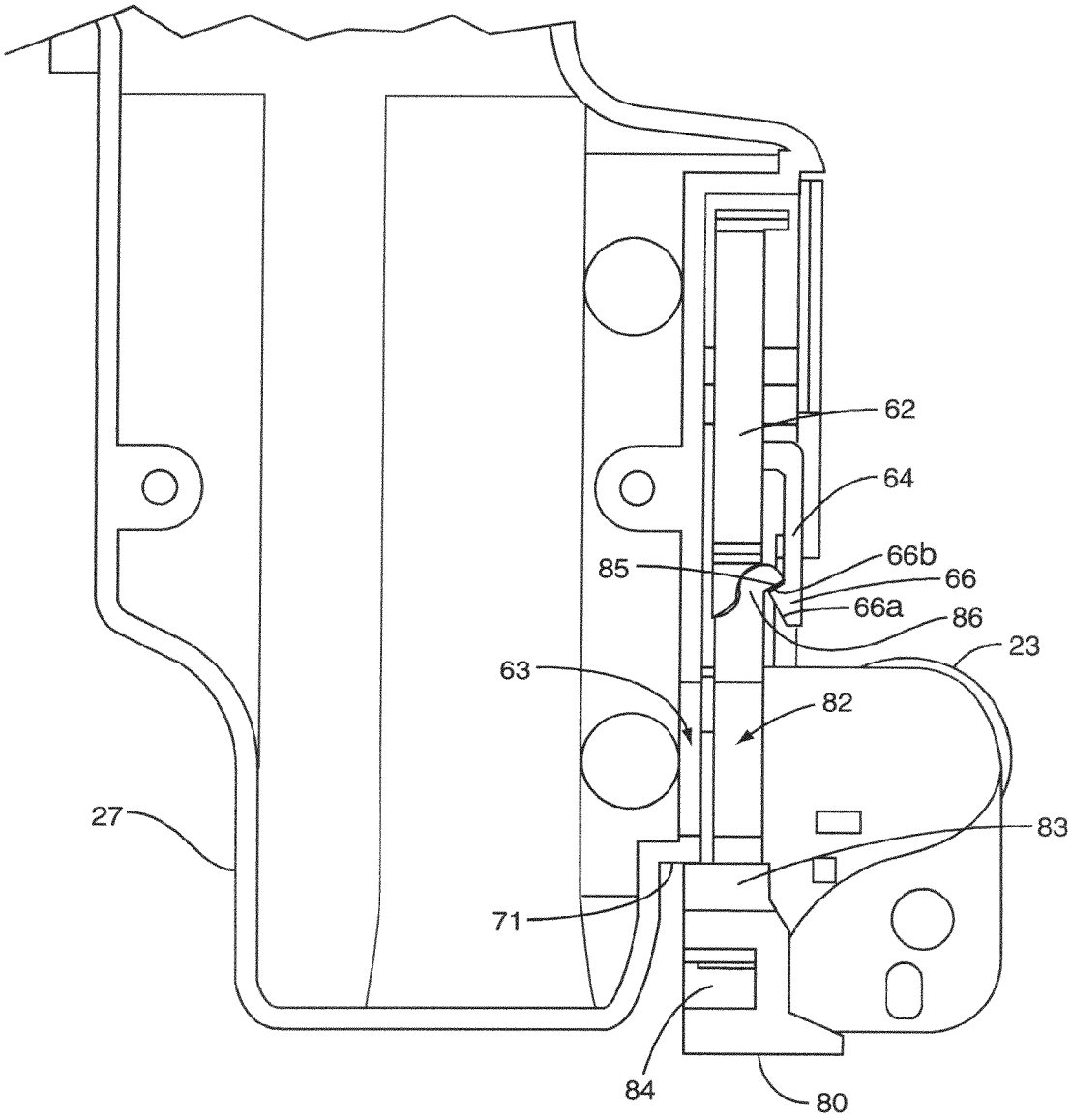
FIG. 5 is a section view of a portion of the toner cartridge coupled to the developer part.

FIG. 5 depicts a section view of the cartridge 27 and developer 23 when the cartridge 27 is fully seated in the image forming device 10. The cartridge shutter 62 is displaced to the open position by the developer engagement element 86. The developer shutter 80 is also displaced to the open position by the lower lip 71 of the toner cartridge 27. In this position, the cartridge toner passage 63 is aligned with the developer toner passage 82, allowing toner to flow freely from the cartridge 27 into the developer 23.

According to one or more embodiments, when the toner cartridge 27 is removed from the image forming device 10, both the cartridge shutter 62 and the developer shutter 80 are moved from their respective open positions to closed positions, covering the toner passages 63, 82, to retain toner in the cartridge 27 and developer 23, respectively. To accomplish this, each shutter 62, 80 releasably engages the opposite structure, which "pulls" the shutter 62, 80 to the closed position prior to releasing, as the cartridge 27 is withdrawn from the image forming device 10.

In particular, a resilient cartridge shutter engagement arm 64, including a protrusion 66, is attached to the cartridge shutter 62. As the cartridge 27 is inserted into the image forming device 10, and a force $F_{C\text{-}COUPLE}$ is applied, the cartridge shutter engagement arm 64 is deflected around, and engages with, a corresponding lip 85 on the developer engagement member 86. As the cartridge 27 is removed from the image forming device 10, the lip 85 of the developer engagement member 86 pulls the cartridge shutter 62 from the open to the closed position (disengaging the cartridge shutter detent 68 from the recess 74 in the open position and engaging it with the recess 72 in the closed position). As the toner cartridge 27 is further removed from the image forming device 10, and a force $F_{C\text{-}DECOUPLE}$ is applied, the cartridge shutter engagement arm 64 of the cartridge shutter 62 disengages from the toner engagement member 86, freeing the toner cartridge 27 for complete removal. As discussed above, based on the relative angles of surfaces 66*a* and 66*b*, $F_{C\text{-}COUPLE} \neq F_{C\text{-}DECOUPLE}$.

Also as the toner cartridge 27 is inserted into the image forming device 10, dual resilient developer shutter engagement arms 76, each including a protrusion 78, are displaced outwardly by a sloped surface 83 formed in the developer shutter 80, requiring an applied force $F_{D\text{-}COUPLE}$, and then move down to engage with developer shutter engagement recesses 84. When the toner cartridge 27 is removed from the image forming device 10, the developer shutter engagement arms 76 pull the developer shutter from the open position (overcoming the force $F_{D\text{-}LOCK}$ exerted by developer detent surface 88*a*) to the closed position (where developer detent surface 88*b* retains the developer shutter 80 in the closed position). As the toner cartridge 27 is further removed from the image forming device 10, and a force $F_{D\text{-}UNCOUPLE}$ is applied, the developer shutter engagement arms 76 disengage from the developer shutter engagement recesses 84 As discussed above, based on the relative angles of surfaces 88*a* and 88*b*, $F_{D\text{-}COUPLE} \neq F_{D\text{-}DECOUPLE}$. Note that in other embodiments, only one developer shutter engagement arm 76, and one corresponding sloped surface 83 and developer shutter engagement recesses 84 may be provided on the cartridge shutter 62 and developer shutter 80, respectively.

Figure 6B:
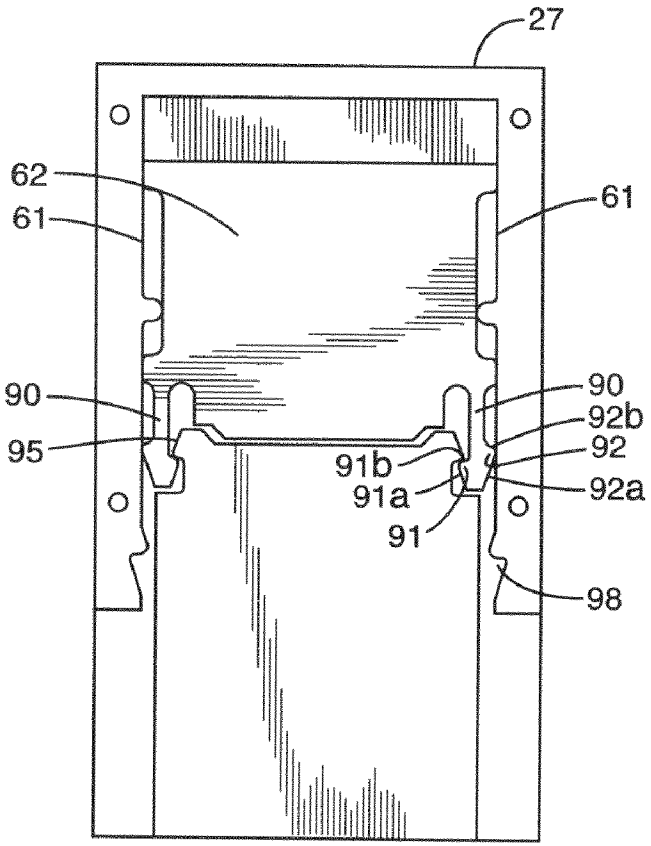
FIGS. 6A and 6B are section views of another embodiment of a toner cartridge coupling to a developer part.
Figure 6A:
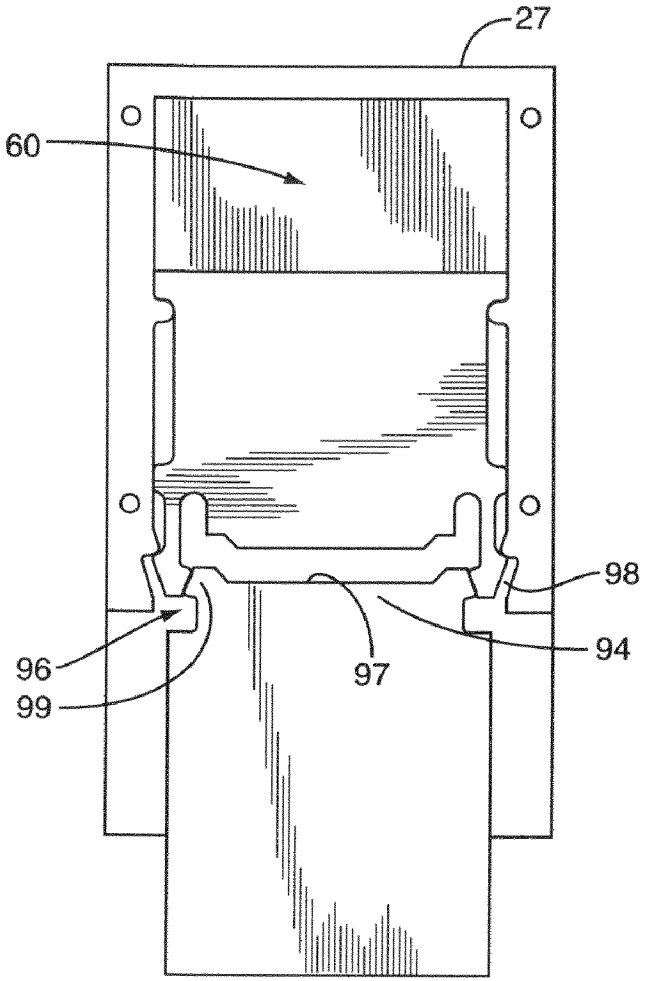

FIGS. 6A and 6B depict an alternative embodiment of the toner cartridge 27. As described above, a cartridge shutter 62 is disposed in a channel 60 defined by side walls 61, and moves within the channel 60 between open and closed positions In lieu of a single, central developer engagement arm 64, the cartridge shutter 62 includes dual developer engagement arms 90, one disposed to each side of the shutter 62. Each developer engagement arm 90 includes an inwardly-facing protrusion 91 (comprising surfaces 91*a* and 91*b*) and an outwardly-facing protrusion 92 (comprising surfaces 92*a* and 92*b*). Another embodiment may include only one developer engagement arm 90, disposed to one side of the cartridge shutter 62.

The developer 23 (or other static part in the image forming device 10) includes a cartridge engagement member 94 having a recess 96 formed in either side thereof, shaped and positioned to receive the developer engagement arm protrusions 91. Stated another way, each recess 96 forms a protrusion 99 in the cartridge engagement member 94. Formed in the side walls 61 are recesses 98, shaped and positioned to receive the developer engagement arm protrusions 92 only when the cartridge shutter 62 is in the fully closed position.

As the toner cartridge 27 is inserted into the image forming device 10, with the cartridge shutter 62 in the fully closed position, the surfaces 91*a* of the developer engagement arm 90 are brought into contact with an angled surface 95 of the cartridge engagement member 94, displacing the developer engagement arms 90 outward, as depicted in FIG. 6A, with a force $F_{C\text{-}COUPLE}$. The developer engagement arms 90 are allowed to flex outwardly by the side wall recesses 98, which receive the outwardly-facing protrusions 92 on the developer engagement arms 90.

As the toner cartridge 27 is inserted further into the image forming device 10, the upper surface 97 of the cartridge engagement member 94 abuts the lower surface of the cartridge shutter 62, and pushes the cartridge shutter 62 toward open position. This movement is resisted by the surface 92*b* of the protrusion 92 on each developer engagement arm 90, in contact with a corresponding surface of the side wall recess 98, requiring the application of a force $F_{C\text{-}UNLOCK}$ to deform the protrusion 92 and move the shutter 62 from the closed position. As discussed below, since the surface 91*a* forms a lesser angle with the direction of the applied force (vertical in FIGS. 6A and 6B) than does surface 92*b*, $F_{C\text{-}UNLOCK}>F_{C\text{-}COUPLE}$. This force relationship ensures that the cartridge shutter 62 will engage with the cartridge engagement member 94 prior to being dislodged from the closed position, ensuring that cartridge engagement member 94 will be able to close the cartridge shutter 62 when the toner cartridge 27 is later removed from the image forming device 10.

Once displaced from the fully closed position, the developer engagement arms 90 are locked into engagement with the cartridge engagement member 94 by the side walls 61, as depicted in FIG. 6B. The developer engagement arms 90 remain locked to the cartridge engagement member 94 as the cartridge 27 is fully seated and the cartridge shutter 62 moves to the fully open position.

As the cartridge 27 is withdrawn from the image forming device 10, the cartridge engagement member 94 pulls the cartridge shutter 62 from the fully open position to the closed position (FIG. 6A). Once the cartridge shutter 62 is in the fully closed position, and the side wall recesses 98 are aligned with the outwardly-facing protrusions 92 of the developer engagement arms 90, then as the cartridge 27 continues to be withdrawn from the image forming device 10, the developer engagement arms 90 are displaced outwardly, into the sidewall recesses 98, and disengage from the cartridge engagement member 94 (FIG. 6B). The toner cartridge 27 may then be removed from the image forming device 10. Since the developer engagement arms 90 can only deform outwardly when the cartridge shutter 62 is fully closed (due to the location of the side wall recesses 98), the cartridge shutter 62 must be in the fully closed position a decouple with the cartridge engagement member 94 is possible, ensuring that the cartridge shutter 62 is fully closed prior to the cartridge 27 being removed from the image forming device 10.

The embodiment depicted in FIGS. 6A and 6B is particularly advantageous when other forces acting on the cartridge shutter 62 may tend to decouple the shutter 62 from the developer 23 before the shutter 62 is fully closed. For example, the back of the cartridge shutter 62 may be covered with a compliant sealing material to form a better seal over the toner passage 63. The compliant material will raise the frictional forces opposing the motion of the cartridge shutter 62 within the channel 60. While this is not an issue when opening the shutter 62 (i.e., inserting the cartridge 27), it tends to decouple the shutter 62 from the developer 23 as the shutter 62 is being pulled closed (i.e., while removing the cartridge 27). By locking the developer engagement arms 90 to the cartridge engagement member 94 by the side walls 61 when the cartridge shutter 62 is at least partially open, the cartridge shutter 62 cannot inadvertently be decoupled from the developer 23. Hence, the toner cartridge 27 cannot be removed from the image forming device 10 without the cartridge shutter 62 first being moved and locked into the fully closed position.

In an image forming device 10 having the above-described features, according to either embodiment of the cartridge shutter 62 (both of which, like the disclosed embodiment of the developer shutter, are representative only and not limiting), toner is retained in the toner cartridge 27 and the developer 23 when the cartridge 27 is not seated in the image forming device 10. Upon inserting a new cartridge 27, the cartridge shutter 62 is opened by abutment against the developer 23, and the developer shutter 80 is opened by abutment against the cartridge 27, as the cartridge 27 moves into the image forming device 10. The cartridge shutter 62 also releasably engages the developer 23, and the developer shutter 80 releasably engages the cartridge 27. As the cartridge 27 is fully seated in the image forming device 10, both the cartridge shutter 62 and the developer shutter 80 are in their respective open positions, and toner may freely flow from the toner cartridge 27, through the cartridge toner passage 63, the developer toner passage 82, and into the developer 23.

When the toner cartridge 27 is depleted of toner and removed from the image forming device 10, the cartridge shutter 62 is pulled to the closed position by the developer engagement member 86, and the developer shutter 80 is pulled to the closed position by the developer shutter engagement arms 76. When both shutters are closed, as the cartridge 27 is further removed from the image forming device 10, the cartridge shutter 62 disengages from the developer 23 and the developer shutter 80 disengages from the cartridge 27, and the cartridge 27 is removed. Notably, for both insertion and removal of the toner cartridge 27, only a single motion is required by a user: vertical, in the embodiments depicted above. That is, no twisting or other motion other than insertion/removal of the toner cartridge is required to actuate the cartridge and developer shutters. Additionally, no springs are required to close the shutters, resulting in a lower-cost design.

In one embodiment, the engagement of the cartridge shutter 62 to the developer 23 and the engagement of developer shutter 82 the cartridge 27 upon inserting the cartridge 27, as well as the relative disengagement of these parts upon removing the cartridge 27, do not occur simultaneously, to avoid large forces (i.e., $F_{C\text{-}COUPLE}+F_{D\text{-}COUPLE}$ and $F_{C\text{-}DECOUPLE}+F_{D\text{-}DECOUPLE}$) associated with simultaneous engagement/disengagement deflection. The relative timing of the coupling engagements can be controlled by the relative positioning of the engagement points along the length of the cartridge 27 travel.

For the step-by-step sequence of events described above to occur in the proper order, some relationships among the various forces imposed by detents and coupling members must be observed. In particular, upon inserting the cartridge 27 into an image forming device 10, each shutter should couple to its corresponding part prior to being dislodged from the closed position, to ensure that it will be returned to the closed position when the cartridge 27 is removed from the image forming device 10. That is, for each shutter, $F_{UNLOCK}>F_{COUPLE}$. Similarly, upon removing the cartridge 27, each shutter should be locked into the fully closed position prior to decoupling from the corresponding part moving it, to ensure that toner is sealed within the part. That is, for each shutter, $F_{UNCOUPLE}>F_{LOCK}$. Accordingly, for proper operation, $F_{UNLOCK}>F_{LOCK}$, $F_{UNCOUPLE}>F_{COUPLE}$, or both.

Figure 7:
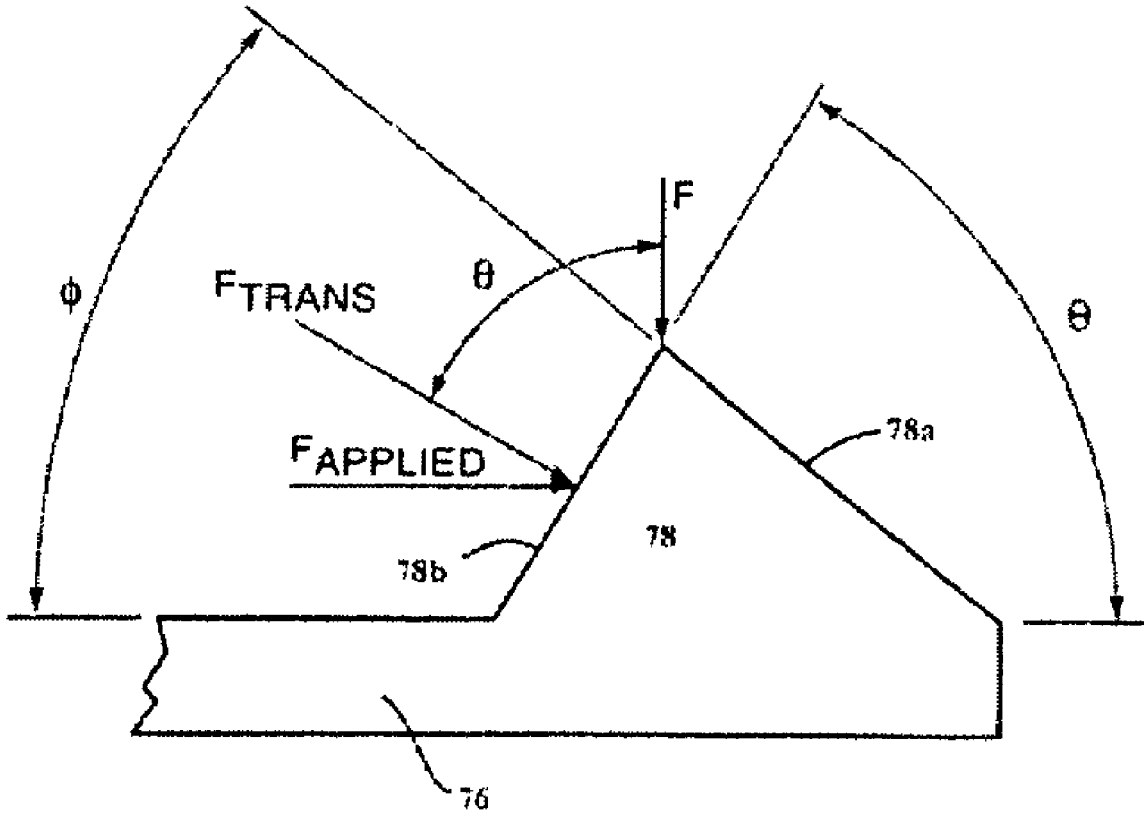
FIG. 7 is a free-body force diagram of a deformable detent having different angled surfaces.

One way to control the different lock/unlock forces imposed by a detent and the different couple/decouple forces imposed by a releasable engagement mechanism is by varying the angles of contact with the corresponding surface. As an example, consider $F_{D\text{-}UNCOUPLE}$, controlled by the surface 78*b* of the developer shutter engagement arm 76, depicted as a free body diagram having a horizontal orientation in FIG. 7. As force is applied to the cartridge 27 in a direction to remove it from the image forming device 10, a force $F_{TRANS}$ is transmitted to the protrusion 78, in a direction normal to the surface 78*b*. The transmitted force $F_{TRANS}$ may be decomposed into a horizontal applied force vector $F_{APPLIED}$ and a vertical force vector F acting to deflect the developer shutter engagement arm 76 outwardly (downwardly in FIG. 7).

The magnitude of the force F required to deflect the engagement arm 76 is known (determined by, e.g., the length and resilience of the arm 76, the depth of the developer shuttle engagement recess 84, and the like). If the angle of surface 78*b* with the horizontal is $\Theta$, then the applied force $F_{APPLIED}=F_{D\text{-}UNCOUPLE}$ necessary to deflect the arm 76 is $F*\tan(\Theta)$. If $\Theta=0$, $F_{D\text{-}UNCOUPLE}=0$. If $\Theta=90$, $F_{D\text{-}UNCOUPLE}=\infty$. Thus, for a given force F, the force required to uncouple the developer shuttle may be varied between 0 and $\infty$ by varying the angle $\Theta$ of contact (of course, with respect to this particular example, the fact of two developer shutter engagement arms 76 must be taken into account).

Similarly, if surface 78*a* makes an angle $\phi$ with the horizontal, then $F_{D\text{-}COUPLE}=F*\tan(\phi)$ is required to deflect the developer shutter engagement arm 76 by the angled developer shutter surface 83 upon inserting the cartridge 27 into the image forming device 10. In similar fashion, the relative couple/decouple forces imposed by the cartridge shutter engagement arms 64, 90 may be controlled by the relative angles of surfaces 66*a* and 66*b*, and 91*a* and 91*b*, respectively. The relative lock/unlock forces imposed by the detents 68, 88, 92 may be controlled by the relative angles of surfaces 70*b* and 70*a*, 88*b* and 88*a*, and 92*a* and 92*b*, respectively.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. An image forming device, comprising:

a developer supplying toner to an image forming station;

a removable cartridge holding a supply of toner, in toner flow relationship with the developer when the cartridge is inserted into the image forming device;

a shutter on the developer operative to retain toner in the developer in a closed position, and operative to allow toner to flow into the developer in an open position; and a shutter on the cartridge operative to retain toner within the cartridge in a closed position, and operative to allow toner to flow from the cartridge in an open position; wherein both the developer shutter and the cartridge shutter are moved to the open position by inserting the cartridge into the image forming device, and both the developer shutter and the cartridge shutter are moved to the closed position by removing the cartridge from the image forming device, wherein the developer shutter engages a portion of the cartridge so that when the removable cartridge is removed from the image forming device, the removable cartridge directly moves the developer shutter to a closed position, wherein opening and closing the developer shutter and the cartridge shutter require no user action other than inserting the cartridge into the image forming device and removing the cartridge from the image forming device, respectively.

2. The device of claim 1 wherein at least one of the developer shutter and the cartridge shutter are held in the closed position by a deformable detent on the respective developer or cartridge.

3. An image forming device, comprising:

a developer supplying toner to an image forming station;

a removable cartridge holding a supply of toner, in toner flow relationship with the developer when the cartridge is inserted into the image forming device;

a shutter on the developer operative to retain toner in the developer in a closed position, and operative to allow toner to flow into the developer in an open position; and a shutter on the cartridge operative to retain toner within the cartridge in a closed position, and operative to allow toner to flow from the cartridge in an open position; wherein both the developer shutter and the cartridge shutter are moved to the open position by inserting the cartridge into the image forming device, and both the developer shutter and the cartridge shutter are moved to the closed position by removing the cartridge from the image forming device, wherein at least one of the developer shutter and the cartridge shutter are held in the closed position by a deformable detent on the respective developer or cartridge, wherein the force required for the developer shutter to overcome the detent and move towards the open position is $F_{D\text{-}UNLOCK}$ and the force required for the cartridge shutter to overcome the detent and move towards the open position is $F_{C\text{-}UNLOCK}$.

4. The device of claim 3 wherein the force required for the developer shutter to overcome the detent and move to the closed position is $F_{D\text{-}LOCK}$ and the force required for the cartridge shutter to overcome the detent and move to the closed position is $F_{C\text{-}LOCK}$.

5. The device of claim 4 wherein $F_{D\text{-}UNLOCK}>F_{D\text{-}LOCK}$.

6. The device of claim 4 wherein $F_{C\text{-}UNLOCK}>F_{C\text{-}LOCK}$.

7. The device of claim 4 wherein the developer shutter comprises a compliant attachment member operative to releasably connect to the cartridge, whereby the cartridge moves the developer shutter to the open position as it is inserted into image forming device.

8. The device of claim 7 wherein the developer shutter compliant attachment member requires an applied force of $F_{D\text{-}COUPLE}$ to releasably connect to the cartridge.

9. The device of claim 8 wherein $F_{D\text{-}UNLOCK}>F_{D\text{-}COUPLE}$.

10. The device of claim 8 wherein the developer shutter compliant attachment member requires an applied force of $F_{D\text{-}UNCOUPLE}$ to release its connection to the cartridge.

11. The device of claim 10 wherein $F_{D\text{-}UNCOUPLE}>F_{D\text{-}COUPLE}$.

12. The device of claim 10 wherein $F_{D\text{-}UNCOUPLE}>F_{D\text{-}LOCK}$.

13. The device of claim 4 wherein the cartridge shutter comprises a compliant attachment member operative to releasably connect to a static, element in the image forming device whereby the static element moves the cartridge shutter to the open position as the cartridge is inserted into image forming device.

14. The device of claim 13 wherein the static element is the developer.

15. The device of claim 13 wherein the cartridge shutter compliant attachment member requires an applied force of $F_{C\text{-}COUPLE}$ to releasably connect to the static element.

16. The device of claim 15 wherein $F_{C\text{-}UNLOCK}>F_{C\text{-}COUPLE}$.

17. The device of claim 13 wherein the cartridge shutter compliant attachment member requires an applied force of $F_{C\text{-}UNCOUPLE}$ to release its connection to the static element.

18. The device of claim 17 wherein $F_{C\text{-}UNCOUPLE}>F_{C\text{-}LOCK}$.

19. An image forming device, comprising:

a protrusion connected to a static element in the image forming device;

a developer supplying toner to an image forming station;

a removable cartridge holding a supply of toner, in toner flow relationship with the developer when the cartridge is inserted into the image forming device;

a shutter on the cartridge operative to retain toner within the cartridge in a closed position, and operative to allow toner to flow from the cartridge in an open position;

a channel having two side walls formed in the cartridge, within which the cartridge shutter moves between the closed and open positions, at least one of the side walls having a recess formed therein; and at least one deformable protrusion member connected to the cartridge shutter, each disposed adjacent a side wall of the channel and, with the cartridge shutter in the closed position, operative to engage a corresponding static element protrusion by deforming outwardly from the cartridge shutter into a corresponding channel side wall recess as the cartridge is inserted into the image forming device; wherein, as the cartridge is inserted further into the image forming device, contact with the static member moves the cartridge shutter from the closed to the open position within the channel, and the deformable protrusion members are locked into engagement with the corresponding static element protrusions by the channel side walls.

20. The device of claim 19 wherein, as the cartridge is removed from the image forming device, the cartridge shutter is moved from the open to the closed position by the locked engagement of the deformable protrusion members with the corresponding static element protrusions.

21. The device of claim 20 wherein, when the cartridge shutter reaches the closed position as the cartridge is removed from the image forming device, the deformable protrusion members disengage from the corresponding static element protrusions by deforming outwardly into corresponding channel side wall recess.

22. An image forming device, comprising:

a developer supplying toner to an image forming station;

a removable cartridge holding a supply of toner, in toner flow relationship with the developer when the cartridge is inserted into the image forming device;

a shutter on the developer operative to retain toner in the developer in a closed position, and operative to allow toner to flow into the developer in an open position; and a shutter on the cartridge operative to retain toner within the cartridge in a closed position, and operative to allow toner to flow from the cartridge in an open position;

wherein both the developer shutter and the cartridge shutter are moved to the open position by inserting the cartridge into the image forming device, and both the developer shutter and the cartridge shutter are moved to the closed position by removing the cartridge from the image forming device, wherein the developer shutter engages a portion of the removable cartridge so that when the removable cartridge is removed from the image forming device, the removable cartridge directly moves the developer shutter to a closed position, and wherein at least one of the developer shutter and the cartridge shutter are held in the closed position by a deformable detent on the respective developer or cartridge.

* * * * *